United States Patent [19]

Amann et al.

[11] 3,996,678

[45] Dec. 14, 1976

[54] FREE-FALL GRAB

[75] Inventors: Hans M. Amann, Hannover; Fritz Otto Poeppel, Luthe, both of Germany

[73] Assignee: Preussag Aktiengesellschaft, Germany

[22] Filed: Sept. 11, 1975

[21] Appl. No.: 612,234

[30] Foreign Application Priority Data

Sept. 16, 1974 Germany ..... 2444167

[52] U.S. Cl. ..... 37/183 R; 37/184; 214/656; 294/70; 212/84

[51] Int. Cl.[2] ..... B66C 3/02

[58] Field of Search ..... 37/183 R, 183 A, 184, 37/185, 186, 54; 214/147, 145, 650, 656, 657; 294/70; 212/42, 44, 81, 84

[56] References Cited

UNITED STATES PATENTS

| | | | |
|---|---|---|---|
| 418,889 | 1/1890 | Cooper et al. | 37/183 R X |
| 667,476 | 2/1901 | Wirsing | 37/185 |
| 1,082,263 | 12/1913 | Craven | 37/185 |
| 1,437,392 | 12/1922 | Botten | 37/184 |
| 1,833,389 | 11/1931 | Carney | 37/184 |
| 3,303,590 | 2/1967 | Grospas | 37/183 R |
| 3,523,614 | 8/1970 | Walker | 37/184 X |
| 3,762,078 | 10/1973 | Wetherbee | 37/184 |

FOREIGN PATENTS OR APPLICATIONS

| | | | |
|---|---|---|---|
| 1,350,017 | 12/1964 | France | 37/185 |
| 175,557 | 1/1905 | Germany | 37/184 R |
| 261,842 | 10/1911 | Germany | 37/184 R |
| 412,404 | 4/1925 | Germany | 37/183 A |
| 402,320 | 5/1923 | Germany | 37/183 R |

*Primary Examiner*—E. H. Eickholt
*Attorney, Agent, or Firm*—Allegretti, Newitt, Witcoff & McAndrews

[57] ABSTRACT

A scissors-type, free-fall grab is disclosed for picking up ground samples from a sea bed. The grab includes two grab halves which may pivot relative to one another. A transverse bar engages the upper ends of the grab halves to hold the grab in its opened position. This transverse bar is attached by a cable arrangement to a buoyancy member. Upward movement of the buoyancy member causes the transverse bar to become disengaged from the upper ends of the grab halves and forces the grab halves to move to their closed position. The grab carried weights which fall off of the grab as the grab moves from its opened to its closed position.

10 Claims, 6 Drawing Figures

FREE-FALL GRAB

BACKGROUND AND SUMMARY OF THE INVENTION

The present invention relates to a free-fall grab, and more particularly to a free-fall, scissors-type grab for picking up ground samples from the sea bed.

A free-falling device for picking up ground samples from the bed of a waterway is known from German Auslegeschrift No. 1,911,782. This free-falling device includes two relatively pivotable grab halves arranged on the buoyancy member which halves are pretensioned by springs in the closing direction and are held in the open position by tension cables. For the purpose of closing the device, the tension cables are freed by a release mechanism which is effected dynamically by a percussion effect which is exerted by the buoyancy member on the release mechanism when the device strikes the sea bed. If this percussion effect is small because, for example, the surface of the sea bed is soft, no release will take place. Consequently, the halves of the grab are not closed and in addition, the weights which are resting on the grab halves also do not fall off so that the complete device remains on the sea bed. The danger of such a malfunction occurring is increased since the release mechanism is loaded by the total closing forces of the springs and the dynamic forces created by the impact of the weights, which are resting on the grab halves of the device, on the sea bed.

For avoiding non-release effects and hence, the loss of the complete device, it is already known to allow the free-falling device to sink without buoyancy members so that the device will strike the sea bed with its full weight. In this way, the reliable actuation of a switch is assured since the switch readily responds to a small force and an impact is not necessary to cause this small force, but just the weight of the device will suffice. The switch electrically fires a small explosive charge which actuates a piston for closing the halves of the grab and which in addition, forces water out of a cavity so that the necessary buoyancy is established. Because of the use of electric current and explosive charges, this arrangement is not only costly and complicated, but in addition, is unreliable. The explosive charge must be exactly measured and the switch must function reliably. Simultaneously, the current source must be sufficient. In the event of non-release, the complete device does not return to the surface and is, therefore, lost.

Our invention has for its object to provide a free-falling grab for picking up samples from the sea bed, which grab operates without springs that have to be tensioned for closing the grab halves, without electric current sources and without explosive charges. Moreover the grab of the present invention is simple and robust in design and construction and impact on the sea bed is unnecessary for the release of the grab since the grab is reliably released even when resting on the sea bed and thus its return to the surface is assured.

The object forming the basis of the invention is achieved by the fact that the grab is a scissors-type grab wherein the grab halves form the lower arms of the "scissor." When the grab is in the open position, the upper arms of the scissors frictionally and/or nonpositively engage the outer ends of a bar which is arranged on the buoyancy member in such a way that the bar holds the grab in an open position when the bar is not supported by the buoyancy member. The engagement between the upper arms and the bar is terminated when the bar is supported by the buoyancy member which is itself connected to the upper arms of the grab by means of cables or pivoted bars wuch that the grab is closed as a result of upward movement of the buoyancy member.

With the solution according to the invention, a reliable release of the closing mechanism is effected, even with a soft sea bed, i.e. without assistance of dynamic forces. During the descent, the upper arms of the grab are forcefully urged into engagement with the bar on the buoyancy member under the action of their own weight, and more particularly, of the depending, expendable weights mounted on the grab. When the opened scissors-like arrangement is resting on the sea bed, these forces are no longer exerted so the upper arms free the previously tensioned bar, and hence the buoyancy member is able to ascend. In principle, a frictional holding engagement between the upper arms and the bar is sufficient, but the bearing surfaces on the upper arms and the bar can also be of such an inclination that in addition, a positive force component becomes effective. Furthermore, it may be desirable to make this positive force component adjustable, by adjusting the slope of the bearing surfaces, or more particularly, by providing adjustable, threaded pins which are adapted to engage in corresponding complementary recesses.

According to another advantageous feature of the invention, the ends of the upper arms of the scissors-type grab are connected by a cable which, with the grab open, connects the ends of the upper arms over substantially the shortest path. The middle of this cable is connected to the buoyancy member. The use of a cable for closing the grab is a particularly simple and reliable means. It is further desirable for another or second cable to extend between the middle of the aforementioned cable and the buoyancy member. This additional cable is of such a length that the buoyancy member is operative or exerts an upward force on the grab only when its speed or ascent has been reached. In this way, not only the work, which can be produced by the buoyancy forces, is supplied for closing the grab, but simultaneously the kinetic energy of the upwardly moving buoyancy member is also used. Consequently, great reliability is provided with respect to the closing of the grab halves and more particularly, with respect to causing the weights to fall off of the grab.

In order to guarantee a reliable suspension of the grab on the bar of the buoyancy member, it is desirable for the bar to be pivotably connected to the buoyancy member. In this way, the grab is always depending perpendicularly beneath the bar so that the weights on the grab will not slip off the grab prior to the closing of the grab.

A further advantageous feature of the invention consists in the fact that the weights are arranged laterally on the grab. It is thereby assured that the weights will not interfere with the closing of the halves of the grab. Furthermore, this arrangement of the weights makes possible a very convenient release of the weights. The weights rest on a support which is provided on the grab and include, on their upper side, slots which are open upwardly and which are engaged by pins when the grab is in its open position. The pins are disposed on the upper arms of the grab and are disengaged from the slots with the closing of the grab. The weights are thus securely held on the grab during handling operations prior to descent and during the descent. Moreover, it is also possible, by proper design of the recesses and pins, to determine accurately at what closing angle of the grab halves the weights will fall off the grab. This means that it is possible to assure that the weights are disposed on the grab practically throughout the entire closing operation of the grab halves so as to press the grab firmly against the bottom and thus guarantee a suitable collection of material. On the other hand, it is nevertheless assured that the weights will be thrown off just before the closing movement is completed. All this is achieved with a very simple construction. The center of gravity of the weights is preferably chosen so that it is outside the support so as to further assure that the weights fall off of the grab.

DESCRIPTION OF THE DRAWINGS

The invention is more fully explained by reference to embodiments shown in the drawings.

DESCRIPTION OF THE PREFERRED EMBODIMENTS

Figures 1, 2, 3, 4:
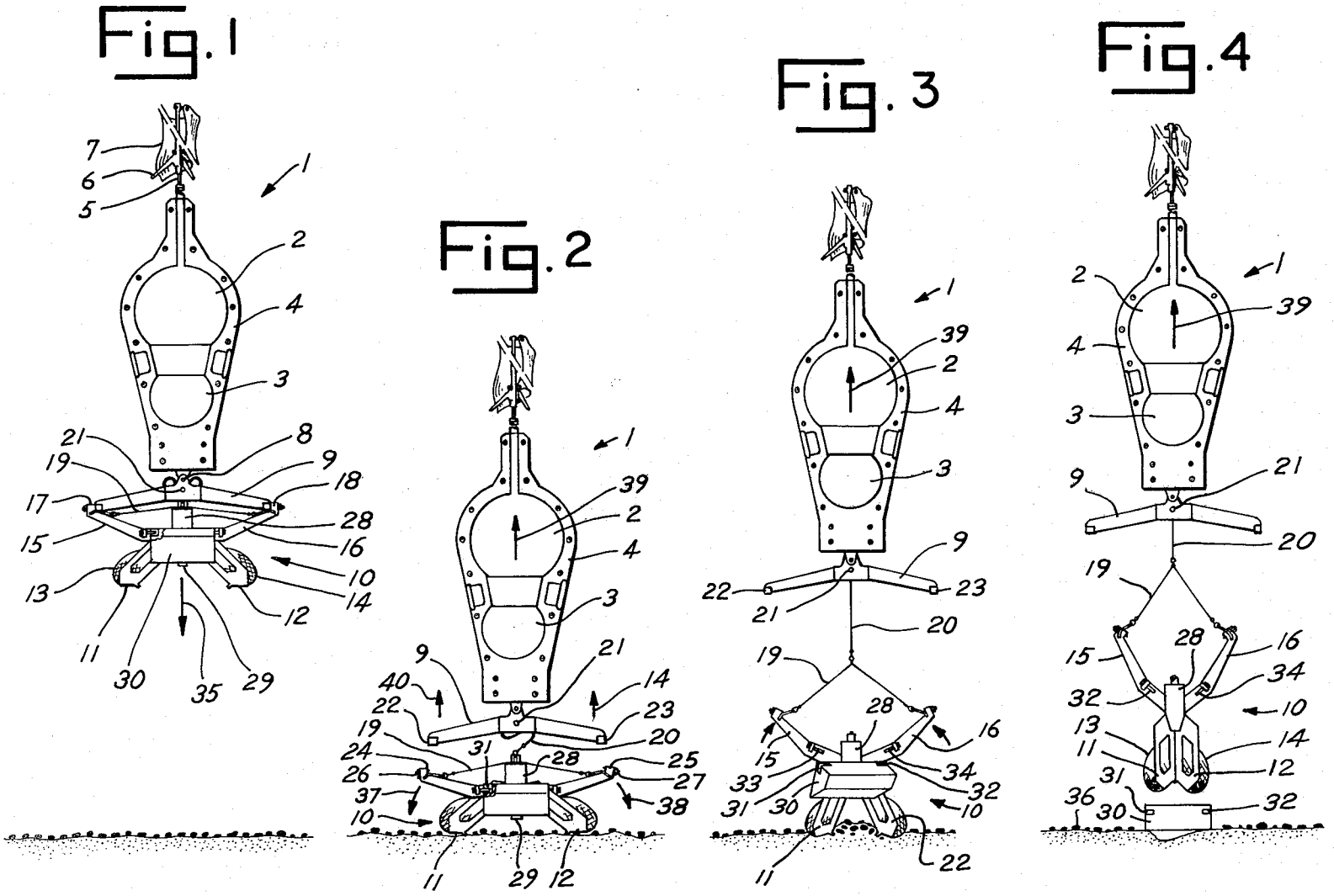
FIG. 1 shows a free-fall grab embodying the principles of the present invention during descent of the grab toward the sea bed.
FIG. 2 shows the grab of FIG. 1 as it impacts against the sea bed.
FIG. 3 shows the grab of FIG. 1 as it is being closed after striking the sea bed.
FIG. 4 shows the grab of FIG. 1 as it is being raised from the sea bed.

An improved scissors-type free-fall grab of the present invention is shown in FIGS. 1 to 4 and includes a buoyancy member 1 formed of two glass spheres 2 and 3 that are held by a frame 4. A rod 4 is arranged on the top of the frame 4 and has a hook 6 for picking up the free-fall grab by means of nets. In addition the rod 5 has a small flag 7 for marking the location of the free-fall grab when it has once again broken the surface of the sea.

A bar 9 is pivotably arranged on the underside of the frame 4 by means of a bolt 8. This bar 9 constitutes a balance beam, so that a scissors-type grab mechanism, shown generally at 10, hanging therebeneath always hangs perpendicularly beneath the bar 9.

The grab mechanism 10 comprises lower arms which form grab halves 11 and 12. These grab halves 11 and 12 are substantially open frames which are closed by collecting bags 13 and 14 used for receiving the material to be picked up. Upper arms 15 and 16 of the grab mechanism 10 are connected and move with the grab halves 11 and 12, respectively. The arms 15 and 16 are connected at their distal ends 17 and 18 by a cable 19. The cable 19 connects the ends 17 and 18 over substantially the shortest distance when the grab 10 is in the open position, as shown in FIGS. 1 and 2. At its center, the cable 19 is attached by means of another cable 20, to a bolt 21 on the bar 9.

Abutment surfaces 22 and 23 are arranged on the outer ends of the bar 9 and are capable of bearing and engaging corresponding abutment surfaces 24 and 25 on the ends 17 and 18 of the upper arms 15 and 16. In addition, screw bolts 26 and 27 are provided in the ends 17 and 18. The pointed ends of the bolts 26 and 27 emerge from the abutment surfaces 24 and 25, respectively, and when the surfaces 24 and 25 are bearing against the abutment surfaces 22 and 23, project into and engage corresponding recesses in the abutment surfaces 22 and 23. In this regard, it should be noted that the pointed ends or tips of the screw bolts 26 and 27 and the corresponding recesses on the abutment surfaces 22 and 23 cannot be clearly seen in FIGS. 1–4 since they are too small in view of the size or scale of the drawings.

A substantially U-shaped mounting stirrup 28 is arranged on the pivot bearing of the scissors-type grab mechanism 10. The stirrup 28 extends over the width of the grab mechanism 10 and its downwardly directed arms engage the pivot bearings of the grab mechanism 10. A support 29 for a weight 30 is disposed on the lower end of each of the lateral arms of the bearing stirrup 28. This support 29 is so constructed that the weight 30 can safely rest thereon without slipping laterally, but can at the same time, tilt outwardly. The weight 30 is provided at its top and on both of its sides with slots 31 and 32 which are open upwardly and towards the side. When the grab mechanism 10 is open, these slots 31 and 32 are engaged by pins 33 and 34 which are attached to the upper arms 15 and 16 of the grab mechanism 10.

The use of the free-fall grab is illustrated in FIGS. 1–4, and the manner in which it operates is hereinafter more fully described.

First of all the free-fall grab is brought into a position such as shown in FIG. 1. This means that the scissors-type grab mechanism 10 is open and the abutment surfaces 24 and 25 may be brought into enagement with the abutment surfaces 22 and 23 on the bar 9. This can be effected by the grab mechanism 10 being first of all placed on a support so that the scissors formation of the mechanism is completely opened and assumes a position such as shown in FIG. 2. During the opening movement, weights 30, one on each side, are placed on the support 29 so that the pins 33 and 34 engage in the slots 31 and 32. Thereafter, the buoyancy member 1, with the rod 9, is attached from above. The buoyancy member is then once again raised, and this simultaneously forces the upper arms 15 and 16 upwardly. The weight of the scissors-type grab mechanism 10 and the weights 30, one on each side, depending therefrom, have the effect that the ends 17 and 18 are moved inwardly and the abutment or bearing surfaces 24 and 25 press firmly against the bearing surfaces 22 and 23 in the bar 9. At the same time, the tip of the screw bolts 26 and 27 engage in the opposite corresponding recesses in the bearing surfaces 22 and 23 and this assures that the grab mechanism 10 hangs reliably on the rod 9 of the buoyancy member 1. While in this condition, the entire free-fall grab is immersed in the sea or water and is released so that it descends, in the direction of an arrow 35 shown in FIG. 1, and strikes the sea bed 36.

FIG. 2 shows the free-fall grab shortly after it has made impact with the sea bed 36. While at rest on the sea bed 36, the weight of the grab and of the weights 30, which are loading the bearing points of the grab halves 11 and 12, cause the bearing surfaces 24 and 25 no longer to be pressed against the bearing surfaces 22 and 23. Also the tips of the screw bolts 26 and 27 are no longer engaging in the corresponding recesses. Rather the ends 26 and 27 of the upper arms 15 and 16 are forced apart and are moved in the direction of arrows 37 and 38 as shown in FIG. 2. As a result, the bar 9 becomes freed from the grab mechanism 10, so that the buoyancy member 1 is able to move upwardly in the direction of an arrow 39. Since the bar 9 is pivotably suspended from the frame 4 of the buoyancy member 1, it is also moved upwardly in the direction of arrows 40 and 41. The initially free movement of the buoyancy member 1, in an upward direction, is possible because the cable 20 is made comparatively long and is only tensioned when the buoyancy member 1 has reached substantially its maximum speed of ascent.

FIG. 3 shows the free-fall grab in a position just before the completion of the closing movement of the grab halves 11 and 12. Since the buoyancy member 1, because of the length of the cable 20, is able initially to assume an upwardly directed speed, it is ensured that, at the instant of the tensioning of the cable 20 and thus of the closing of the grab mechanism 10 by means of the cable 19, the force of inertia of the buoyancy member, which is in movement, is available, in addition, to the buoyancy force for the closing of the grab.

During the closing of the grab mechanism 10, the upper arms 15 and 16 and thus also the pins 33 and 34 are moved upwardly relatively to the support 29 so that the pins 33 and 34 emerge from the slots 31 and 32 and the weight 30 is able to fall laterally in the manner which can be seen in FIG. 3. The suppot surface 29 is merely disposed on the inner rim of the weight 30 so that the center of gravity of the weight is outside the support 29 and hence a reliable tipping of the weight 30 from the support 29 is guaranteed. As a result of the formation of the slot arrangement 31 and 32 and of the arrangement of the pins 33 and 34, the instant at which the weight 30 falls off with the closing of the scissors-type grab mechanism 10 can be accurately established. Consequently, the result can be obtained that the weights 30 remain on the grab practically throughout the entire closing operation, and hence, force the grab mechanism 10 on to the sea bed. It is only just before complete closure of the grab mechanism that the weights 30 fall off so that now the buoyancy of the complete arrangement is sufficient to make re-ascent possible.

FIG. 4 shows a free-fall grab shortly after the re-ascent has started. The weights 30, of which only one is visible, have fallen off. The collecting bags 13 and 14 are filled, the grab halves 11 and 12 are closed and are also hald in the closed state by the diagonal path of the two halves of the cable 19. The buoyancy force, effective in the direction of the arrow 39, allows the free-fall grab to return to the surface where it can be located by means of the small flag 7 or additional means, e.g. light sources or wireless transmitters, and can be picked up by means of the hook 6.

Figures 5, 6:
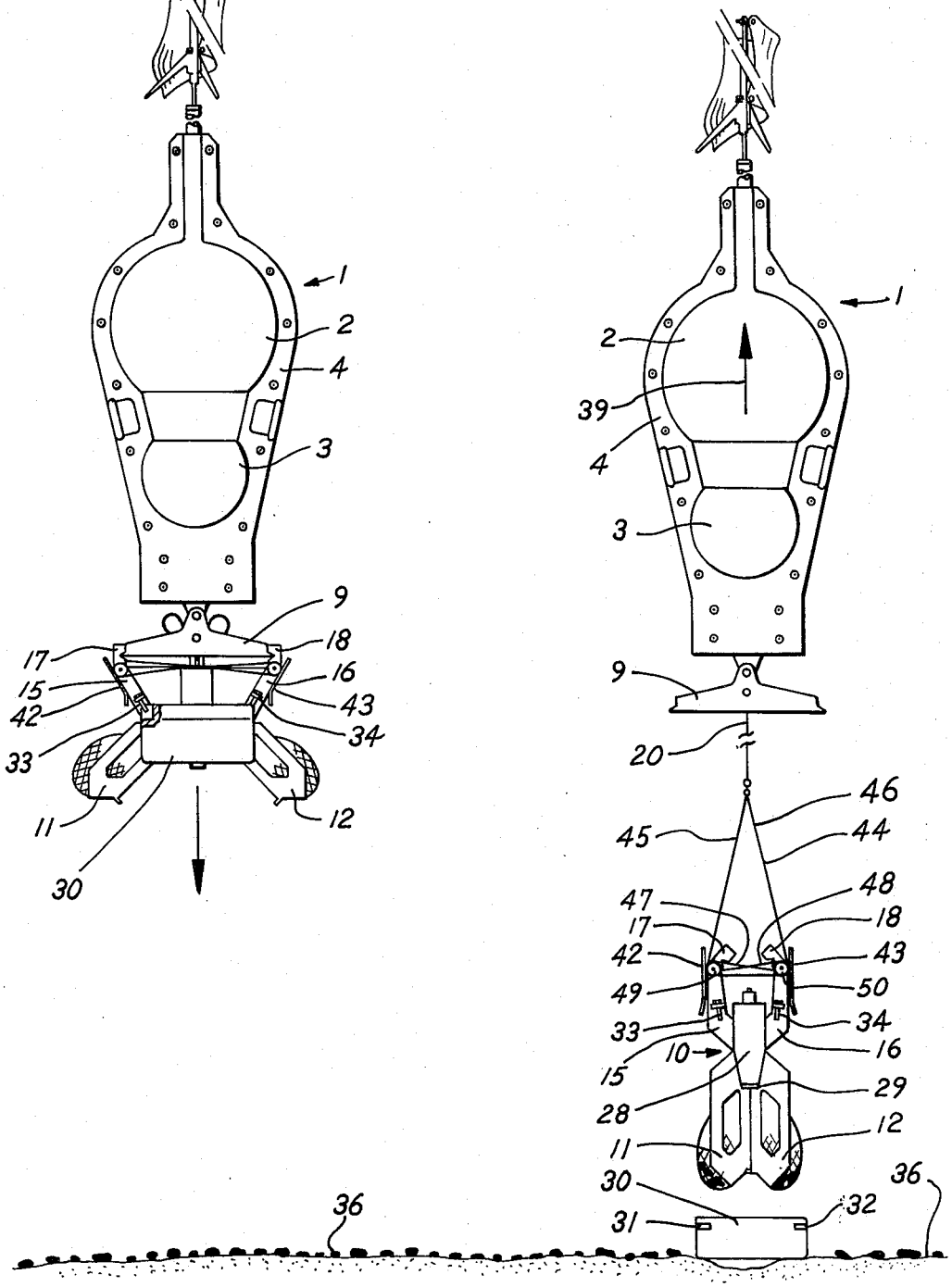
FIG. 5 shows another modified free-fall grab which embodies the principles of the present invention. and which is similar to the grab shown in FIG. 1.
FIG. 6 shows the grab of FIG. 5 as it is being raised from the sea bed.

FIG. 5 shows a modified constructional form, which differs from that shown in FIG. 1 by the fact that the bearing surfaces 24 and 25, and 22 and 23, respectively, are inclined upwardly and inwardly, so that the bearing and holding of the grab is increased and a firm suspension is guaranteed. FIG. 6, which corresponds to FIG. 4, shows the inclined formation of the said bearing surfaces in a particularly clear manner. Furthermore, with the constructional form according to FIGS. 5 and 6, guide plates 42 and 43 are arranged at the ends of the respective arms 15 and 16, the plates being inclined obliquely upwardly and outwardly and, with the descent of the free-fall grab, produces a force which acts in the closing direction of the scissors arrangement, and consequently causes a stronger pressing action of the bearing surfaces 24 and 25 against the bearing surfaces 22 and 23.

With the impact on the sea bed, the water which is also flowing with the free-fall grab during the descent is operative on the rear sides of the guide plates 42 and 43 and forces these apart, whereby the release of the buoyancy member is assisted. As will be seen from FIG. 6, the guide plates 42 and 43 are directed upwardly in the closed position of the grab, so that they do not impede the ascent.

Finally, with the constructional form according to FIGS. 5 and 6, the cable 19 is replaced by a double-acting block and tackle arrangement 44. The free ends 45 and 46 of the arrangement 44 are connected to the bottom end of the cable 20 while other ends 47 and 48 are connected to the ends 17 and 18 of the upper arms 15 and 16 and are each respectively guided beforehand over pulleys 49 and 50. The uplift force of the buoyancy member 1 is multiplied by the action of the block and tackle arrangement 44, while the bearing of the grab mechanism 10 on the sea bed is scarcely affected. Therefore the buoyancy forces are largely converted into closing forces. After the closing of the grab mechanism 10, the buoyancy member 1 carries the grab mechanism 10 with it.

We claim:

1. An improved free-fall grab for picking up ground samples from a sea bed located beneath the surface of the sea, the improved free-fall grab comprising:

a buoyancy member;

a scissors-type grab mechanism positioned beneath the buoyancy member and including first and second lower arms that constitute grab halves and first and second upper arms that are connected and move with the first and second lower arms, respectively, and that have abutment surfaces formed thereon, the first and second arms being pivotably movable relative to one another between a grab half opened position and a grab half closed position;

cable means connecting the scissors-type grab mechanism with the buoyancy member;

at least one weight adapted to be carried by the scissors-type grab mechanism during the descent of the grab to the sea bed;

detachable means attaching the weight to the scissors-type grab mechanism while the arms of the scissors-type grab mechanism are in their opened position and for permitting the weight to fall away from the scissors-type grab mechanism as the arms of the scissors-type grab mechanism move from their opened position to their closed position;

a bar having abutment surfaces formed thereon and being carried by the buoyancy member beneath the buoyancy member and between the buoyancy member and the scissors-type grab mechanism, the abutment surfaces on the bar being adapted to contact the abutment surfaces on the upper arm of the scissors-type grab mechanism when the arms are in their opened position and to remain in contact with the abutment surfaces on the upper arms so as to maintain the arms in their opened position while the free-fall grab is descending toward the sea bed, with the abutment surfaces of the bar being movably out of contact with the abutment surfaces on the upper arms when the lower arms of the scissors-type grab mechanism come to rest on the sea bed so that the buoyancy force of the buoyancy member will cause the arms of the scissors-type grab mechanism to move to their closed position, thereby causing the weight to fall off of the scissors-type grab mechanism, and thereafter will cause the scissors-type grab mechanism to be raised to the surface of the sea.

2. The improved free-fall grab described in claim 1 wherein the cable means includes a first cable which interconnects the ends of the upper arms of the scissors-type grab mechanism; and wherein when the arms of the scissors-type grab mechanism are in their opened position, the first cable connects the ends of the upper arms substantially over the shortest path.

3. The improved free-fall grab described in claim 2 wherein the cable means includes a second cable which is connected to the first cable adjacent the mid-point of the first cable, and extends between the first cable and the buoyancy member; and wherein the second cable has a length such that the buoyancy force of the buoyancy member is not operative on the first cable until after the buoyancy member has substantially reached its speed of ascent.

4. The improved free-fall grab described in claim 1 wherein the abutment surfaces on the bar are inclined upwardly and inwardly.

5. The improved free-fall grab described in claim 1 wherein screw bolts are disposed in the upper arms adjacent to the abutment surfaces on the upper arms and project beyond the abutment surfaces so as to engage corresponding recesses on the ends of the bar.

6. The improved free-fall grab described in claim 1 wherein the bar is pivotably connected to the buoyancy member.

7. The improved free-fall grab described in claim 1 wherein two weights are arranged laterally on the scissors-type grab mechanism; wherein the weights rest on a support member formed on the scissors-type grab mechanism; wherein the weights include side slots which open upwardly; wherein pins are disposed on the upper arms of the scissors-type grab mechanism, are adapted to engage the slots in the weights when the arms are in their opened position and are adapted to disengage from the slots and the weights when the arms move from their opened position to their closed position.

8. The improved free-fall grab described in claim 7 wherein the centers of gravity of the weights are disposed so that when the pins disengage from the slots in the weights, the weights will fall off of the supports and onto the sea bed.

9. The improved free-fall grab described in claim 1 wherein guide plates are arranged on the ends of the upper arms such that they point obliquely upwardly and outwardly when the arms of the scissors-type grab mechanism are in their opened position and extend substantially perpendicularly to the surface of the sea when the arms are in their closed position.

10. The improved free-fall grab described in claim 1 wherein the cable means includes a cable which is guided over pulleys mounted on the ends of the upper arms of the scissors-type grab mechanism such that a block and tackle arrangement is formed between the ends of the upper arms of the scissors-type grab mechanism.

* * * * *